US012546333B2

(12) United States Patent
Wu et al.

(10) Patent No.: US 12,546,333 B2
(45) Date of Patent: Feb. 10, 2026

(54) FAN AND ELECTRONIC DEVICE

(71) Applicant: StonePlus Thermal Management Technologies Limited, Guangdong (CN)

(72) Inventors: Hsiu-Wei Wu, Guangdong (CN); En-Yu Lin, Guangdong (CN); Zhongqi Zhou, Guangdong (CN)

(73) Assignee: STONEPLUS THERMAL MANAGEMENT TECHNOLOGIES LIMITED, Shenzhen (CN)

( * ) Notice: Subject to any disclaimer, the term of this patent is extended or adjusted under 35 U.S.C. 154(b) by 0 days.

(21) Appl. No.: 18/731,485

(22) Filed: Jun. 3, 2024

(65) Prior Publication Data

US 2024/0318662 A1 Sep. 26, 2024

(30) Foreign Application Priority Data

Apr. 15, 2024 (CN) ..... 202410458620.3

(51) Int. Cl.
*F04D 29/42* (2006.01)
*F04D 17/00* (2006.01)
*F04D 29/28* (2006.01)

(52) U.S. Cl.
CPC ..... *F04D 29/4226* (2013.01); *F04D 17/00* (2013.01); *F04D 29/281* (2013.01)

(58) Field of Classification Search
CPC .... F04D 29/4226; F04D 29/281; F04D 17/00; F04D 29/4213
See application file for complete search history.

(56) References Cited

U.S. PATENT DOCUMENTS

2012/0148393 A1 6/2012 Lin et al.
2020/0132080 A1* 4/2020 Chen ..... F04D 29/4226
2024/0318662 A1 9/2024 Wu et al.

FOREIGN PATENT DOCUMENTS

CN 201381995 Y 1/2010
CN 205281316 U 6/2016
CN 114738301 A 7/2022
TW 201135068 A 10/2011

* cited by examiner

*Primary Examiner* — Michael L Sehn
(74) *Attorney, Agent, or Firm* — SHIMOKAJI IP

(57) ABSTRACT

A fan includes a shell, a hub and an impeller. The base cover and the cover plate are arranged in parallel, and the side shell is arranged between the base cover and the cover plate. The cover plate is provided with an air inlet connected with the accommodating chamber and having a diameter smaller than a diameter of the impeller, and the side shell is provided with an air outlet connected with the accommodating chamber. The hub is pivotally installed in the accommodating chamber, the hub and the air inlet are arranged coaxially, and the impeller is arranged in the accommodating chamber and connected with the hub to produce air flow. The cover plate is defined as a first arrangement zone with a plurality of first auxiliary air inlet holes provided. The fan can increase air volume and suppress air leakage.

15 Claims, 15 Drawing Sheets
(3 of 15 Drawing Sheet(s) Filed in Color)

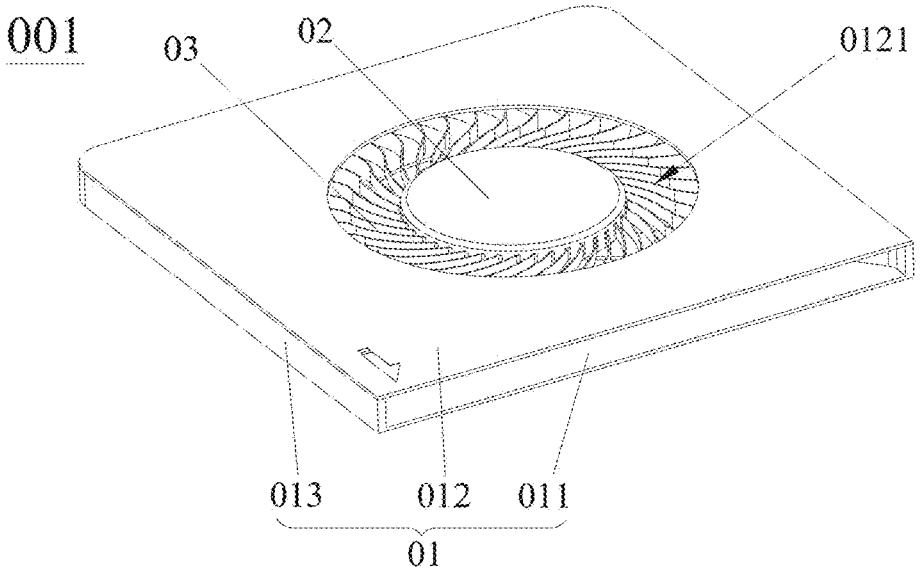
FIG. 17(Prior Art)
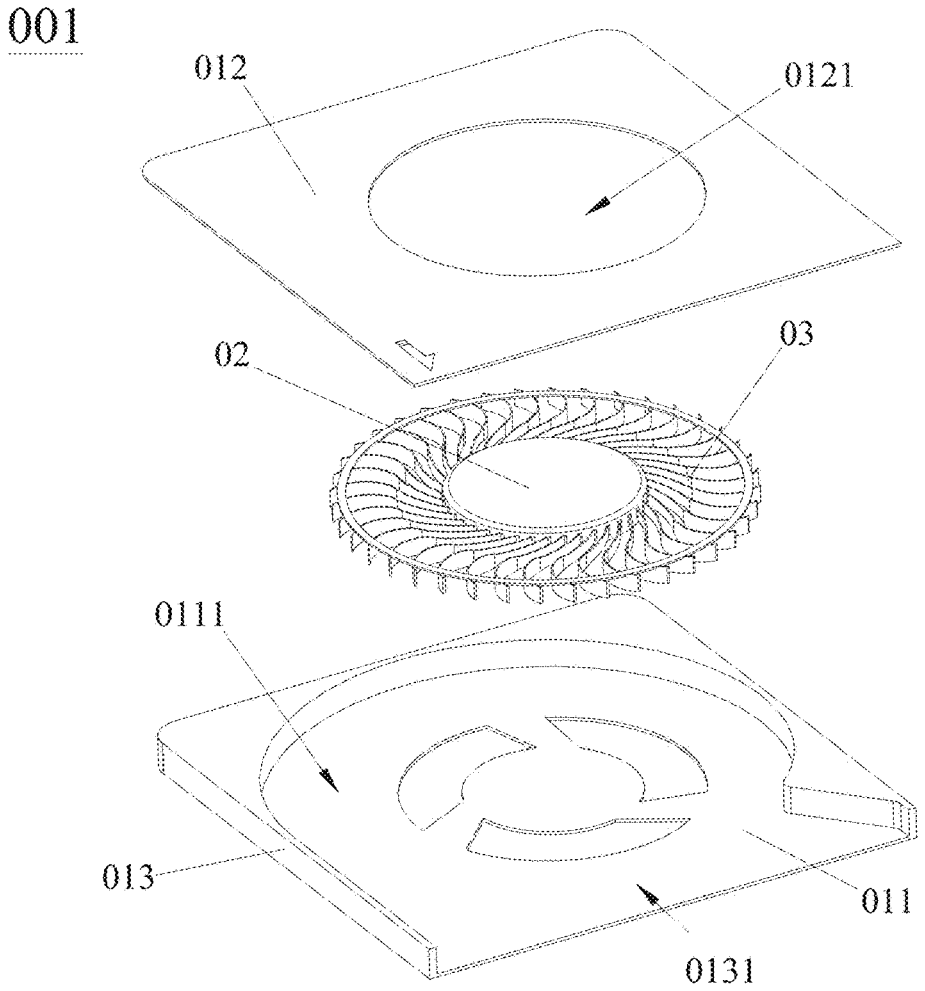
FIG. 18(Priort Art)

Air flow comparison between the embodiments and the prior art under 5000 rpm

FAN AND ELECTRONIC DEVICE

FIELD OF THE INVENTION

The present invention relates to the field of electronic devices, particularly to a fan and an electronic device.

BACKGROUND OF THE INVENTION

The performance of electronic devices such as laptops are largely determined by the heat dissipation performance of the fan built in the laptops. With the performance improvement of the laptop, a higher demand heat dissipation performance of the fan is also required. In the prior art, the diameter of the air inlet is usually smaller than that of the impeller, and a ratio between the area of the air inlet and the area of diameter of the impeller, known as an opening ratio, affects the airflow of the air inlet. In theory, a larger opening ratio means more airflow can be introduced, which can increase the outlet air volume and achieve better heat dissipation effects. However, in practical applications, some of the intended airflow will escape from the air inlet if the opening ratio is too large, thus a normal opening ratio is limited at about 0.8, which cannot increase the air volume as expected. Besides providing an air inlet on the shell, the prior art also provides multiple small holes on the shell. In actual applications, the fan integrated into the system shows weak performance compared with that fan not integrated into the system, due to the impedance issues within the system.

SUMMARY OF THE INVENTION

A purpose of the present invention is to provide a fan that is beneficial to increase air volume and suppress air leakage when applied in a fan system.

Another purpose of the present invention is to provide an electronic device having the fan mentioned above, which is beneficial to increase airflow and suppress air leakage when applied in a fan system.

In order to achieve the purpose mentioned above, the present invention provides a fan including a shell, a hub and an impeller. The shell is provided with an accommodating chamber, and the shell comprises a base cover, a cover plate and a side shell that define the accommodating chamber; the base cover and the cover plate are arranged in parallel, the side shell is arranged between the base cover and the cover plate and is connected with the base cover and the cover plate; the cover plate is provided with an air inlet connected with the accommodating chamber and having a diameter smaller than a diameter of the impeller, and the side shell is provided with an air outlet connected with the accommodating chamber; the hub is pivotally installed in the accommodating chamber, the hub and the air inlet are arranged coaxially, the impeller is arranged in the accommodating chamber and connected with the hub, and the impeller follows a synchronous rotation with the hub to produce air flow; a part of the cover plate facing the impeller is defined as a first arrangement zone surrounding the air inlet, and the first arrangement zone is provided with a plurality of first auxiliary air inlet holes.

Preferably, the first auxiliary air inlet holes are distributed throughout the first arrangement zone.

Preferably, the first arrangement zone includes a first local zone for forming the plurality of first auxiliary air inlet holes, and the plurality of first auxiliary air inlet holes are all distributed on the first local zone.

Preferably, the plurality of first auxiliary air inlet holes are arranged in linear rows, circular rows or staggered positions in the first local zone.

Preferably, the first local zone is arranged by surrounding the air inlet.

Preferably, the base cover is provided with an auxiliary air inlet connected with the accommodating chamber and having an area smaller than the air inlet, the auxiliary air inlet is located directly below the air inlet, a position of the base cover facing the impeller is defined as a second arrangement zone, and the second arrangement zone is provided with a plurality of second auxiliary air inlet holes.

Preferably, the base cover is provided with a plurality of auxiliary air inlets arranged in a circle centered on a center axis of the hub and arranged separately from one another, the second arrangement zone includes a second local zone for forming the plurality of second auxiliary air inlet holes, and plurality of the second auxiliary air inlet holes are all distributed on the second local zone.

Preferably, the second local zone is arranged around at least one of the auxiliary air inlets, and the plurality of second auxiliary air inlet holes are arranged in linear rows, circular rows or staggered positions in the second local zone.

Preferably, the first auxiliary air inlet holes and/or the second auxiliary air inlet holes have a same diameter from top to bottom, or are gradually increased/reduced from top to bottom, or have wider ends and a narrower middle.

Preferably, the first auxiliary air inlet holes and/or the second auxiliary air inlet holes have circular, elliptical or polygonal shapes, and spacing between two adjacent first auxiliary air inlet holes is 1.1 to 4 times a thickness of the cover plate, and spacing between the two adjacent second auxiliary air inlet holes is 1.1 to 4 times a thickness of the base cover.

Preferably, each of the first auxiliary air inlet holes has different diameter, and each of the second auxiliary air inlet holes has different diameter.

When the fan provided in the present invention is in use, the impeller follows the synchronous rotation with the hub to produce the air flow, and then the air flow is directed from the air inlet into the accommodating chamber and exits through the air outlet. By setting the diameter of the air inlet smaller than the diameter of the impeller, the leakage of the introduced air flow at the air inlet is reduced. Additionally, multiple first auxiliary air inlet holes are arranged on the first arrangement zone to allow the air flow into the accommodating chamber, thereby increasing the inlet air volume and subsequently increasing the outlet air volume. On the other hand, the first arrangement zone can still effectively prevent the leakage of the air flow since it's a hard support. Therefore, the fan of the present invention can increase the air volume and meanwhile suppress the leakage of the air flow.

Understandably, the electronic device having the fan described above can improve the air volume meanwhile improve the heat dissipation effect.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 17 is a perspective view of a fan according to the prior art.

FIG. 18 is an exploded perspective view of the fan shown in FIG. 17.

DETAILED DESCRIPTION OF ILLUSTRATED EMBODIMENTS

To provide a detailed explanation of the technical content, and structural features of the present invention, the following is further explained in conjunction with the implementation method and the accompanying drawings.

The present invention discloses a fan 100 applicable to electronic devices, preferably portable devices such as laptops and projectors, for heat dissipation to enhance the performance of the devices.

Figure 1:
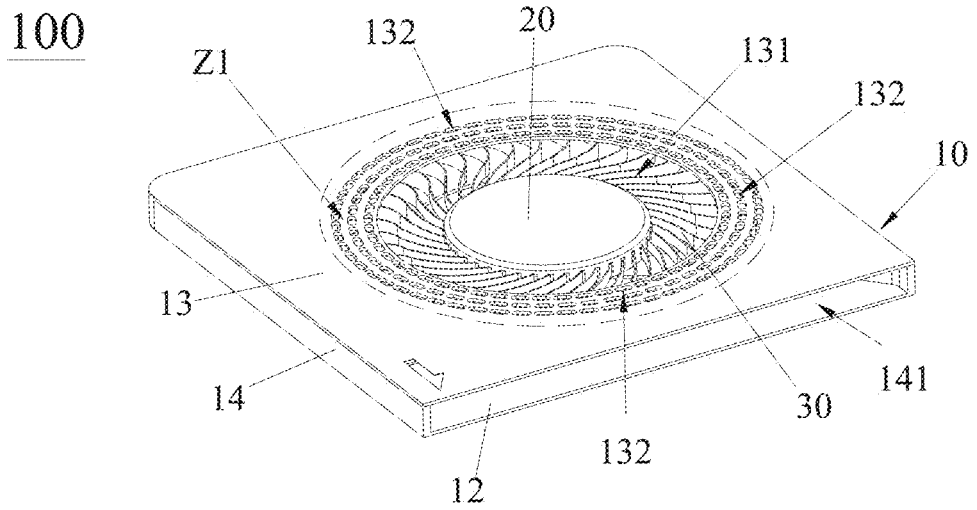
FIG. 1 is a perspective view of a fan according to the first embodiment of the invention.
Figure 2:
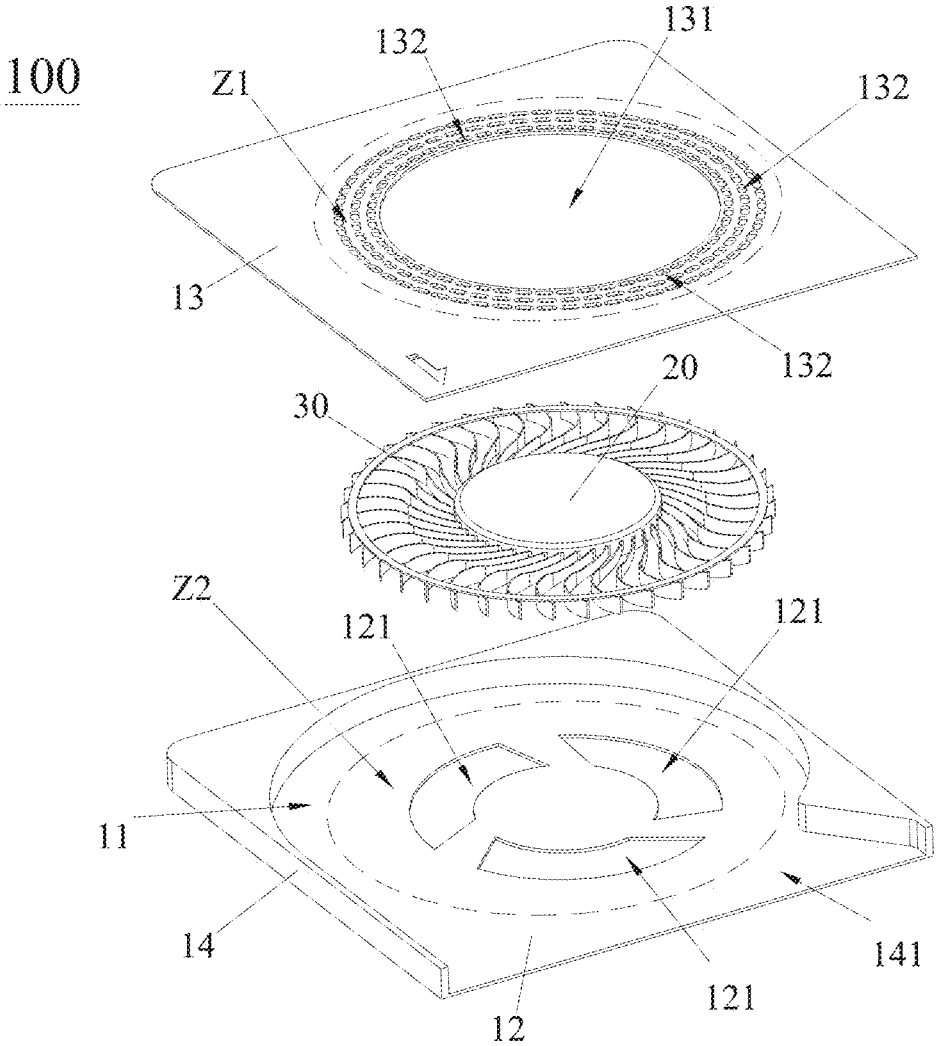
FIG. 2 is an exploded perspective view of the fan shown in FIG. 1.

As illustrated in FIGS. 1 and 2, the fan 100 of the present invention includes a shell 10, a hub 20, and an impeller 30. The shell 10 includes an accommodating chamber 11, consisting of a base plate 12, a cover plate 13, and a side shell 14. The base plate 12 and the cover plate 13 are arranged in parallel, and the side shell 14 is positioned between and connected to the base plate 12 and the cover plate 13, thereby fixing the base plate 12 and the cover plate 13 in place. The cover plate 13 is provided with an air inlet 131 connected with the accommodating chamber 1 and having a diameter smaller than a diameter of the impeller 30. The side shell 14 is provided with an air outlet 141 connected with the accommodating chamber 11. The hub 20 is pivotally installed in the accommodating chamber 11, the hub 20 and the air inlet 131 are arranged coaxially, the impeller 30 is arranged in the accommodating chamber 11 and connected with the hub 20, and the impeller 30 follows the synchronous rotation with the hub 20 to produce air flow. The part of the cover plate 13 facing the impeller 30 is defined as a first arrangement zone Z1 surrounding the air inlet 131, and the first arrangement zone Z1 is provided with a plurality of first auxiliary air inlet holes.

When the fan 10 provided in the present invention is in use, the impeller 30 follows the synchronous rotation with the hub 20 to produce the air flow, and then the air flow is directed from the air inlet 131 into the accommodating chamber 11 and exits through the air outlet 141. By setting the diameter of the air inlet 131 smaller than the diameter of the impeller 30, the leakage of the introduced air flow at the air inlet 131 is reduced. Additionally, multiple first auxiliary air inlet holes 132 are arranged on the first arrangement zone Z1 to allow the air flow into the accommodating chamber 11, thereby increasing the inlet air volume and subsequently increasing the outlet air volume. On the other hand, the first arrangement zone Z1 can still effectively prevent the leakage of the air flow since it's a hard support. Therefore, the fan of the present invention can increase the air volume and meanwhile suppress the leakage of the air flow.

FIG. 17 is a perspective view of a fan 001 according to the prior art, and FIG. 18 is an exploded perspective view of the fan shown in FIG. 17. The fan 001 includes a shell 01, a hub 02, and an impeller 03. The shell 01 includes a base plate 011, a cover plate 012, and a side shell 013, with an accommodating chamber 0111 and an air outlet 0131, structurally similar to the fan according to the present invention. The difference is that the cover plate 012 is only provided with an air inlet 0121.

Figure 20:
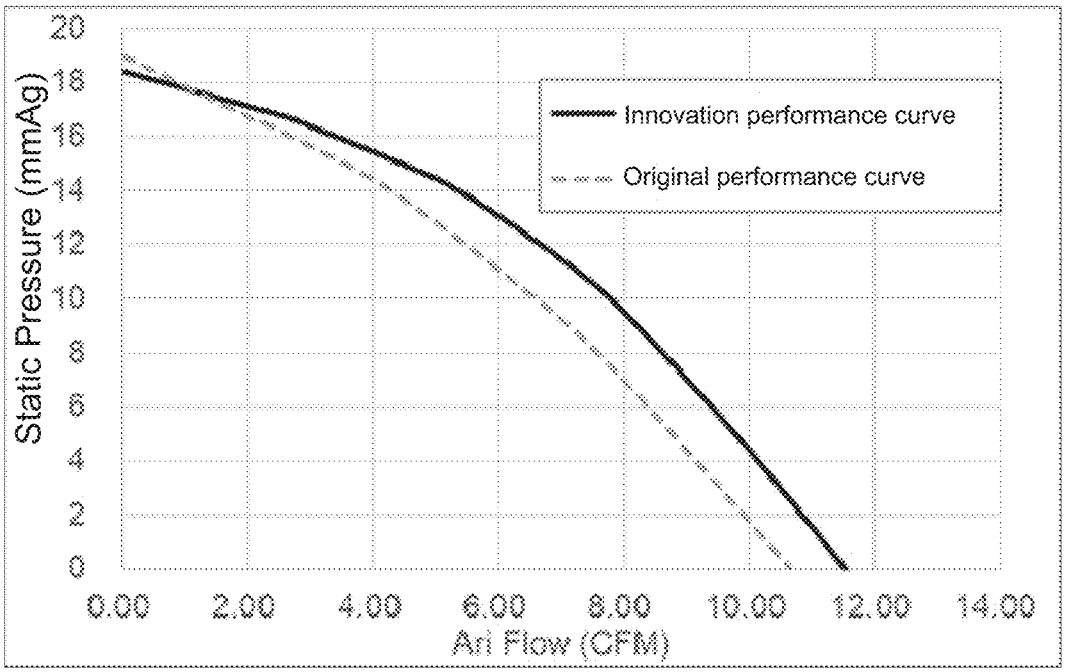
FIG. 20 is a schematic diagram of static pressure-air flow of the fan of the first embodiment and a fan of the prior art shown in FIG. 17.

FIG. 20 is a schematic diagram of static pressure-air flow of the fan of the first embodiment and the fan of the prior art shown in FIG. 17, which shows a curve of static pressure-air flow indicated by a dashed line, called as an original performance curve for the fan of the prior art shown in FIGS. 17 and 18. FIGS. 1 and 2 are respectively a perspective view and an exploded perspective view of the fan according to the first embodiment of the invention, which is shown as a curve of static pressure-air flow indicated by a solid line in FIG. 20, called as an innovation performance curve. In comparison with the fan 001 of the prior art, the air flow in the present invention is increased with 5%, clearly indicating a significant increase in air volume.

Figure 21:
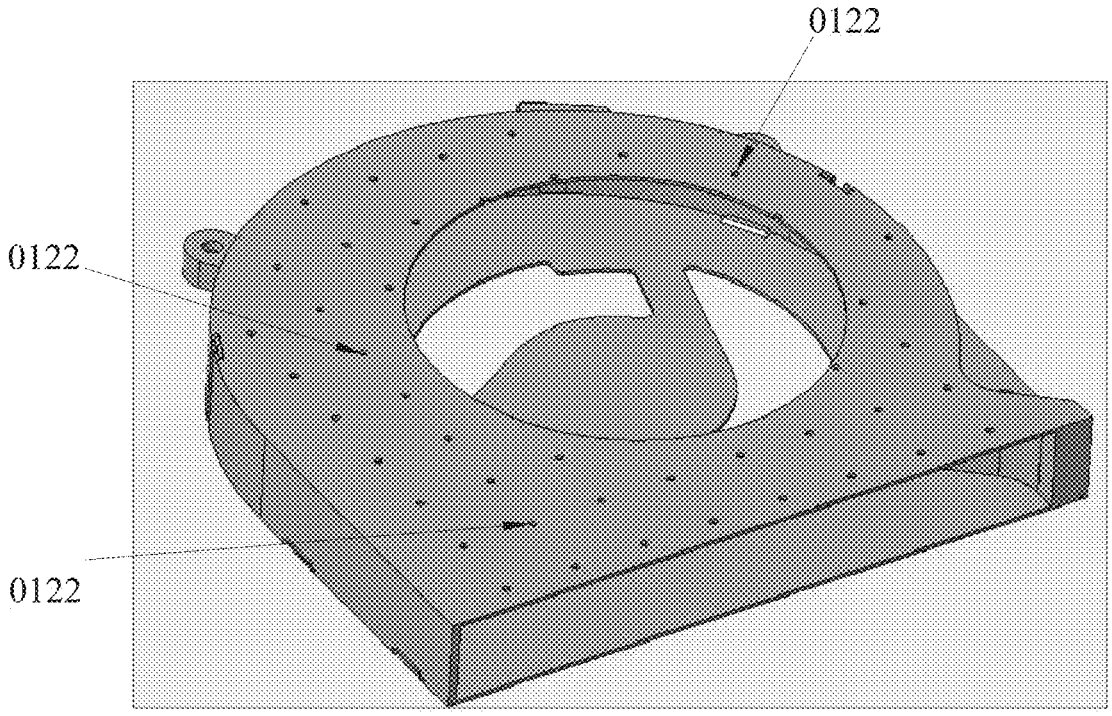
FIG. 21(Prior Art)
FIG. 21 is a perspective view of another fan according to the prior art.
Figure 22:
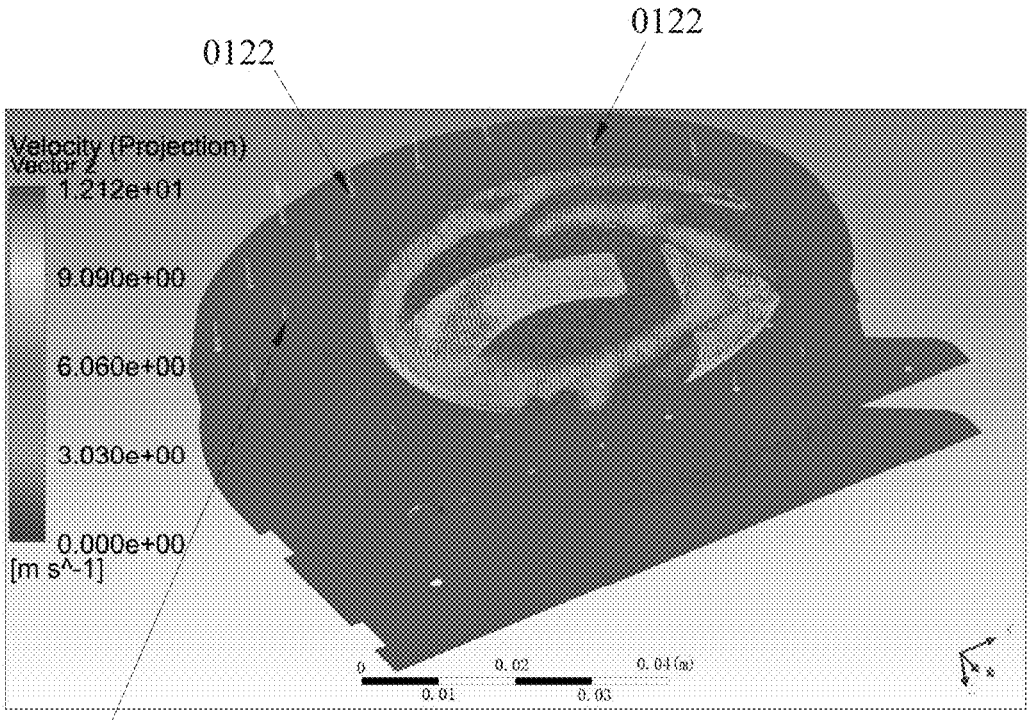
FIG. 22(Prior Art)
FIG. 22 is an air velocity diagram of the fan as shown in FIG. 21.
Figure 23:
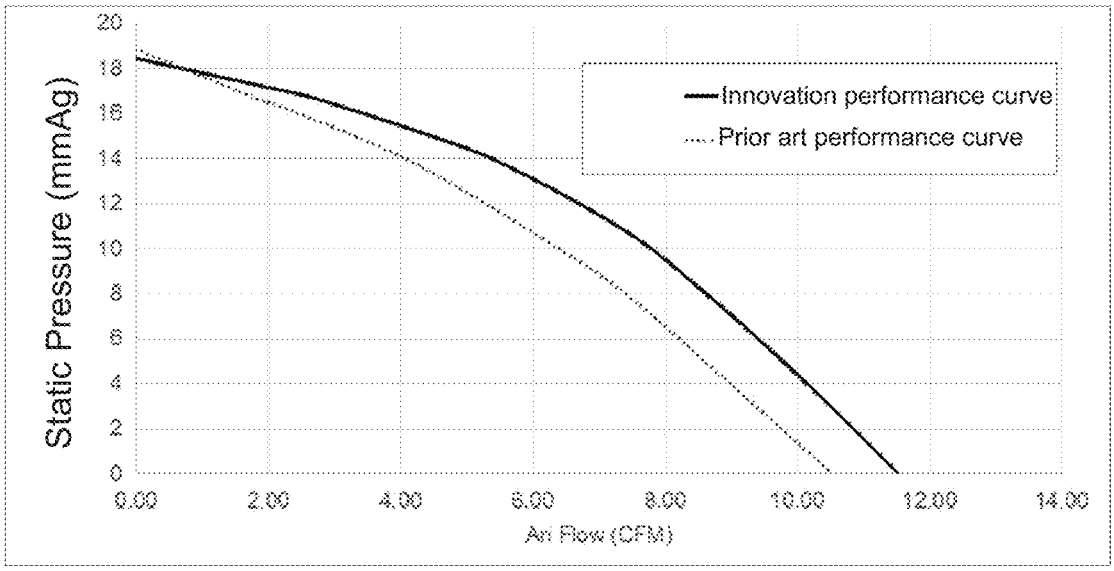
FIG. 23 is a schematic diagram of static pressure-air flow of the fan of the first embodiment 1 and the fan of the prior art shown in FIG. 21.

Furthermore, the prior art further promoted another fan as shown in FIG. 21, which has a plurality of auxiliary air inlet holes 0122 on the cover plate, and has a curve of static pressure-air flow indicated by a dashed line in FIG. 23, called as a prior art performance curve. In contrast, the fan 100 provided in the first embodiment of the present invention only has the first auxiliary air inlet holes 132 in the first arrangement zone Z1, and has a curve of static pressure-air flow indicated by a solid line in FIG. 23, called as an innovation performance curve. Experimentally, the more holes and the larger area of the holes on the cover plate were expected to guide more air flow. However, the results showed the opposite effect, with the fan in the present invention effectively increasing airflow. By this token, within the contemplation of the present invention distinguishing from the prior art, multiple first auxiliary air inlet holes 132 are defined on the first arrangement zone Z1 of the cover plate 13 for directing the air flow into the accommodating chamber 11, thereby effectively increasing air volume while suppressing the air leakage.

Figure 26:
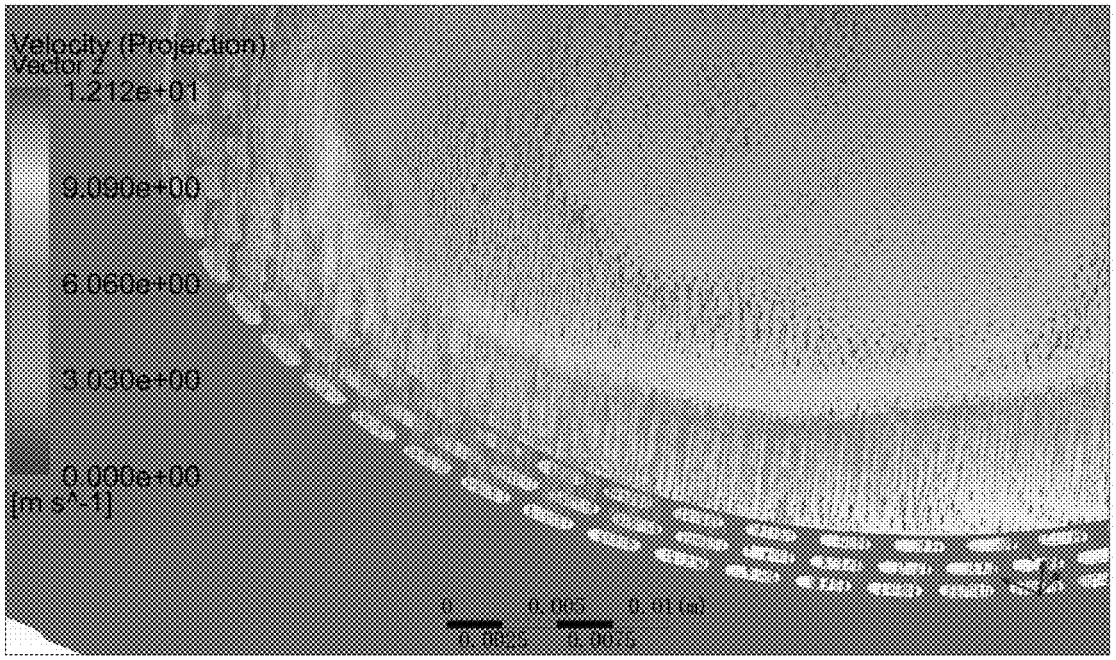
FIG. 26 is an air velocity diagram of the air inlet and auxiliary air inlet according to the first embodiment of the invention.

Moreover, FIG. 26 shows air velocity testing of the fan 100 according to the first embodiment of the present invention, showing varying velocities of the air flow through different first auxiliary air inlet holes 132. The peaks and valleys of the sound waves resulted by the air flow are overlapped, which effectively reduces the noise, improves the sound quality without producing harsh noise, thereby enhancing the user experience.

Figure 24:
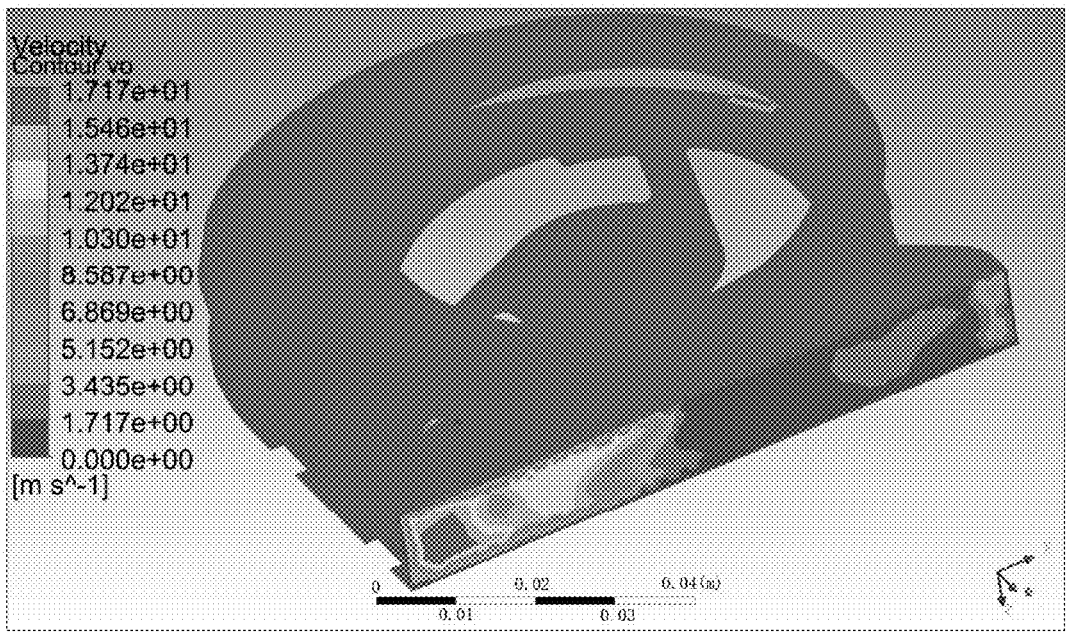
FIG. 24(Prior Art)
FIG. 24 is a cloud chart of the air velocity at the air outlet of the fan according to the prior art shown in FIGS. 17 and 18.
Figure 25:
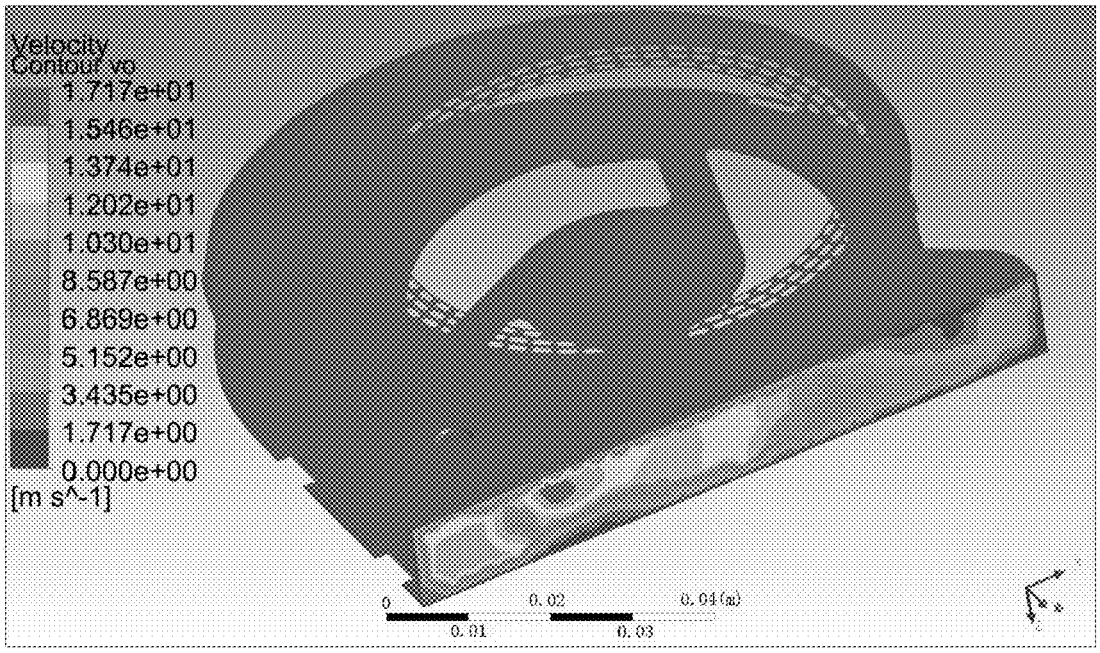
FIG. 25 is a cloud chart of the air velocity at the air outlet of the fan according to the first embodiment of the invention.

FIG. 24 is a cloud chart of the air velocity at the air outlet of the fans according to the prior art shown in FIGS. 17 and 18, and FIG. 25 is a cloud chart of the air velocity at the air outlet of the fan according to the first embodiment of the invention. It's seen that, the fan in the first embodiment of the present invention has a broader velocity distribution at the air outlet and a larger heating dissipation area to improve the heat dissipation efficiency and the heat dissipation effect.

It should be noted that the defined range of the first arrangement zone Z1 is clearly outlined, with its edge positioned directly above the edge of the impeller 30. The air flow entered from the air inlet 131 and the first auxiliary air inlet holes 132 is substantially orthogonal to the air flow blown out from the air outlet 141. The fan 100 is a flat structure to suit the lightweight design of electronic devices.

In summary, the first arrangement zone Z1 surrounding the air inlet 131 is set as a circular zone, and the numbers and the size proportion of the first auxiliary air inlet holes 132 may be configured differently in various embodiments.

In the first embodiment of the invention, as shown in FIGS. 1 and 2, multiple first auxiliary air inlet holes 132 are evenly distributed throughout the first arrangement zone Z1, with large numbers and large size proportion, thereby significantly increasing the output air volume.

In some embodiments, it's possible to configure the first auxiliary air inlet holes 132 on a local zone of the first arrangement zone Z1. For example, several first local zones A1 are defined in the first arrangement zone Z1, on which the first auxiliary air inlet holes 132 are distributed. It's important to note that the area of the first local zone A1 is significantly smaller than that of the first arrangement zone Z1, yet the experimental results indicate that this arrangement can still enhance the air volume. The shape of the first local zone A1 may be set as regular or irregular. The first auxiliary air inlet holes 132 may be arranged on the first local zone A1 in different arrangement patterns.

Preferably, the first local zone A1 is arranged around the air inlet 131, thus more of the first auxiliary air inlet holes 132 is positioned closer to the air inlet 131, which is beneficial to converge the incoming air flow from the air inlet 131 with the incoming air flow from the first auxiliary air inlet holes 132.

Figure 3:
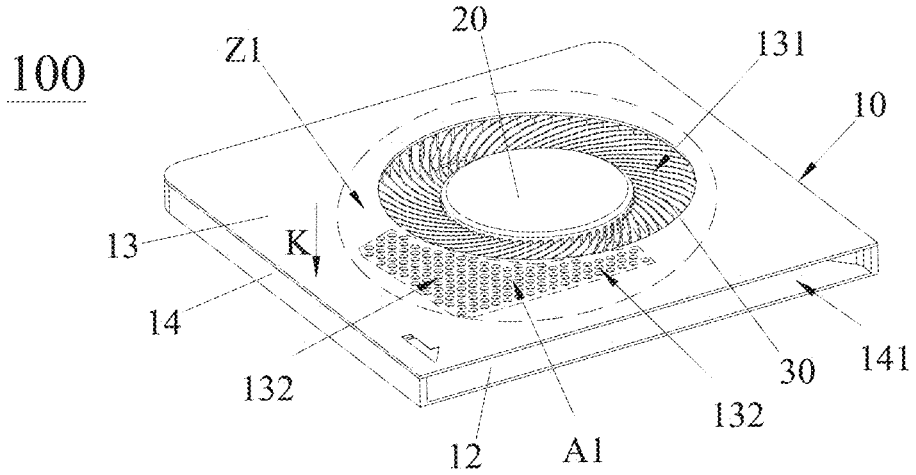
FIG. 3 is a perspective view of a fan according to the second embodiment of the invention.
Figure 4:
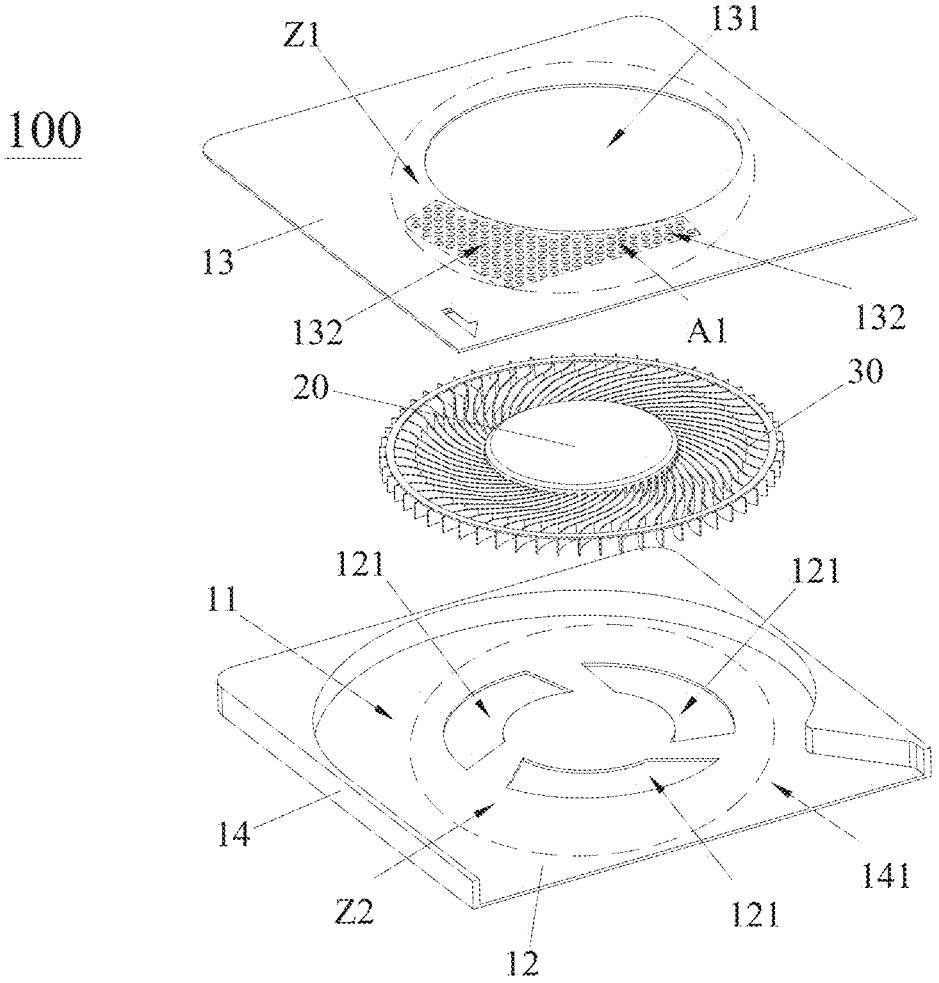
FIG. 4 is an exploded perspective view of the fan shown in FIG. 3.

In a second embodiment as shown in FIGS. 3 and 4, the first local zone A1 is roughly shaped in a right-angled triangle with curved sides. Multiple first auxiliary air inlet holes 132 are distributed within this area A1, aligned in rows. Each row contains a different number of first auxiliary air inlet holes 132. For example in this embodiment, 25 rows of holes are arranged as indicated by arrow K. It should be noted that more or less rows of holes also may be set based on actual demands, which is not limited here.

Figure 5:
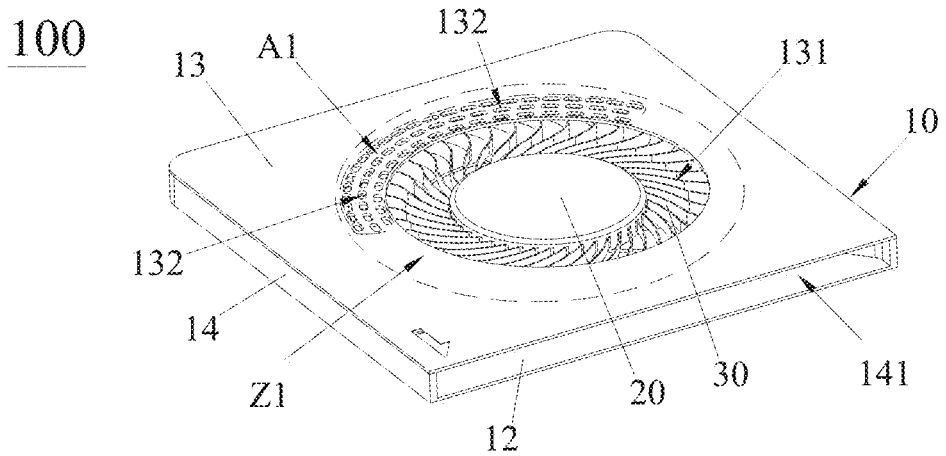
FIG. 5 is a perspective view of a fan according to the third embodiment of the invention.
Figure 6:
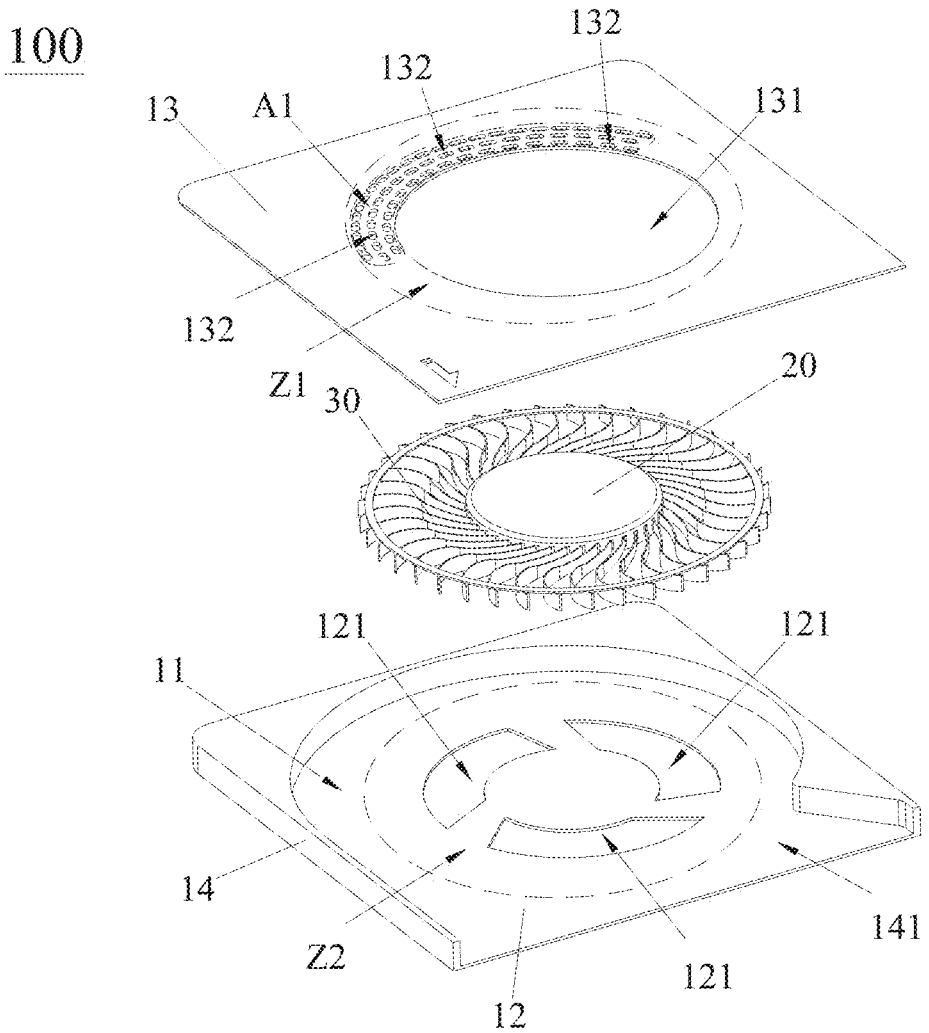
FIG. 6 is an exploded perspective view of the fan shown in FIG. 5.

In a third embodiment as shown in FIGS. 5 and 6, the first local zone A1 is roughly shaped in an arc. Multiple first auxiliary air inlet holes 132 are distributed within this area A1, aligned in arc-shaped rows. Each row contains a different or same number of first auxiliary air inlet holes 132. For example in this embodiment, 3 rows of holes are arranged. It should be noted that more rows of holes also may be set based on actual demands, which is not limited here.

Figure 7:
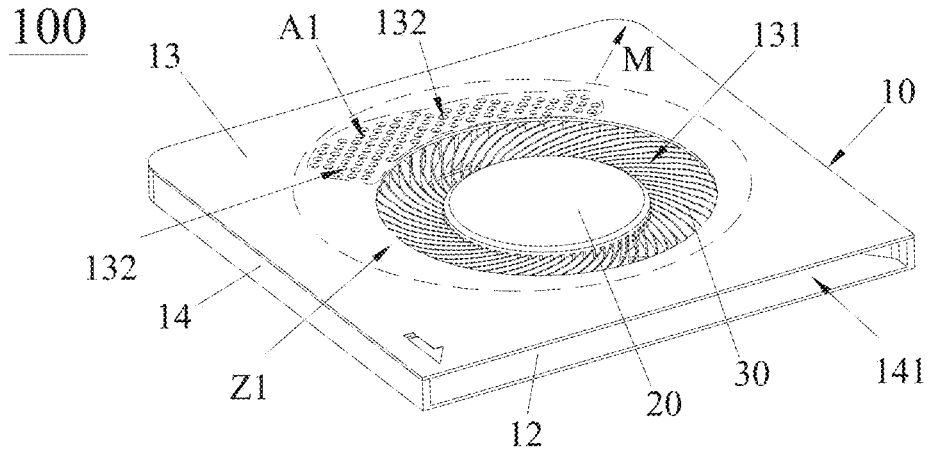
FIG. 7 is a perspective view of a fan according to the fourth embodiment of the invention.
Figure 8:
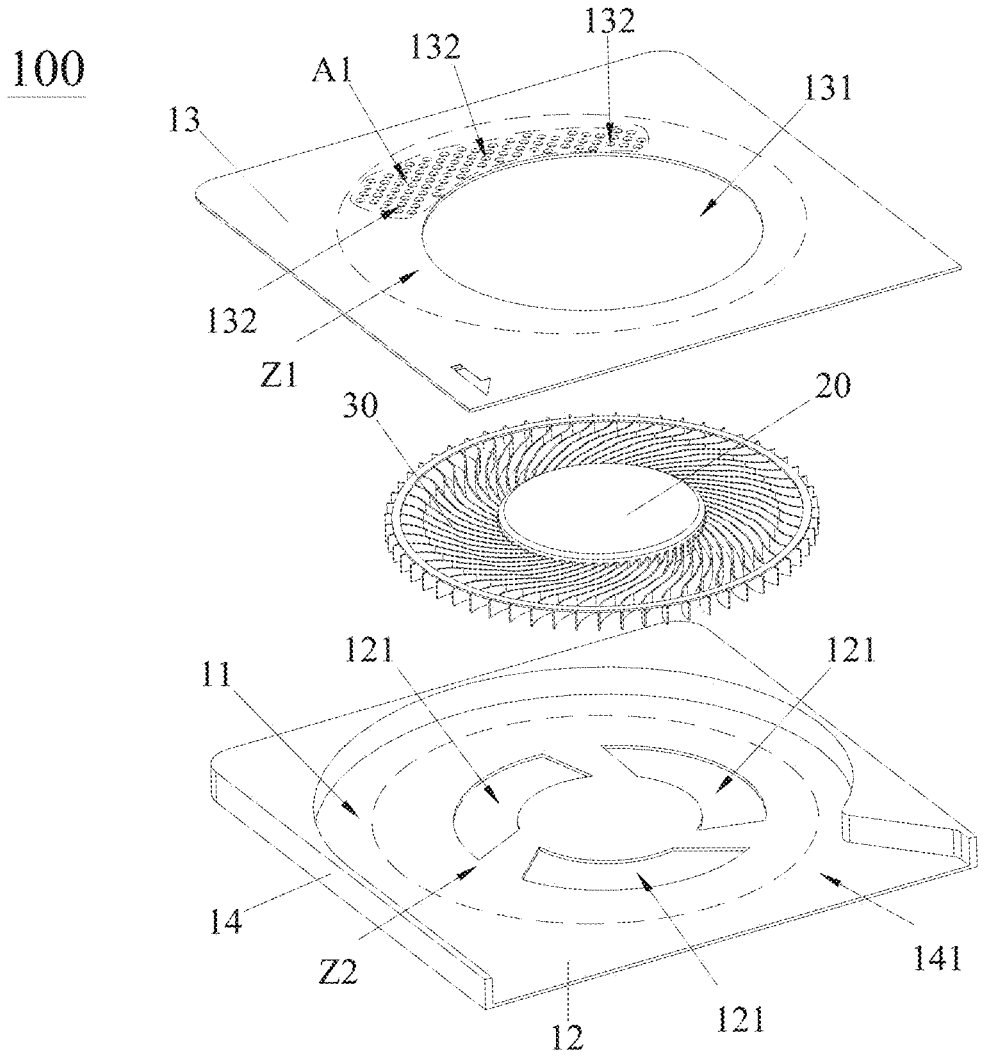
FIG. 8 is an exploded perspective view of the fan shown in FIG. 7.

In a fourth embodiment as shown in FIGS. 7 and 8, the first local zone A1 is roughly shaped in a non-uniform arc shape. Multiple first auxiliary air inlet holes 132 are distributed within this area A1, aligned in linear rows. Each row contains a different number of first auxiliary air inlet holes 132. For example in this embodiment, 18 rows are arranged as indicated by arrow M. It should be noted that more or less rows of holes also may be set based on actual demands, which is not limited here.

Figure 9:
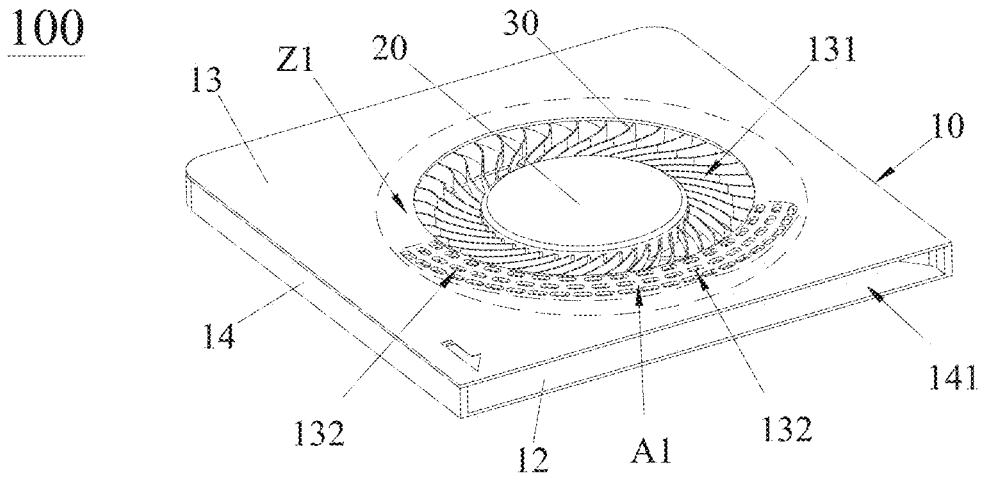
FIG. 9 is a perspective view of a fan according to the fifth embodiment of the invention.
Figure 10:
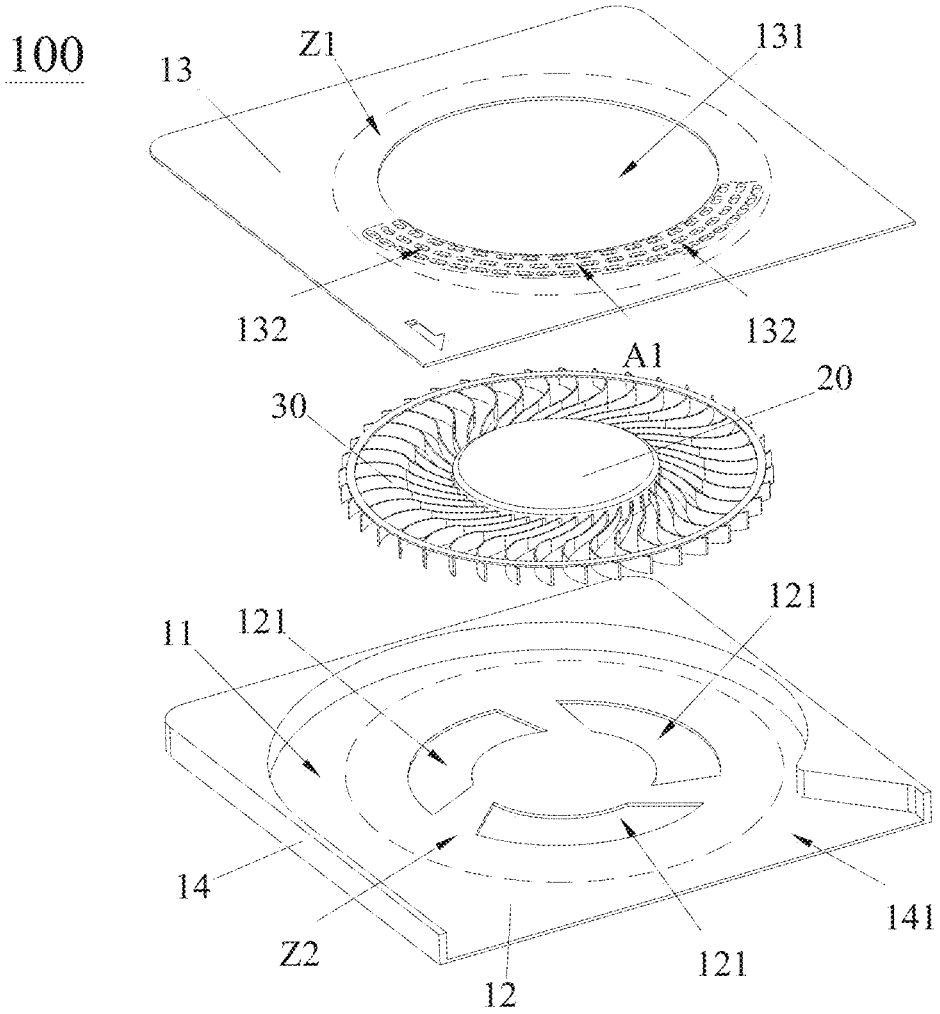
FIG. 10 is an exploded perspective view of the fan shown in FIG. 9.

In some embodiments, the orientation of the first local zone A1 may be adjusted. For example referring to the third embodiment, the first local zone A1 is positioned at the rear. Referring to the fifth embodiment shown in FIGS. 9 and 10, the first local zone A1 is positioned at the front, maintaining the same arrangement of the first auxiliary air inlet holes 132 and the same shape of the first local zone A1. It should be noted that, the adjustments on the orientation of the first local zone A1 bring tiny impact on the air volume, with both configurations yielding nearly identical air volumes (comparison follows).

Figure 11:
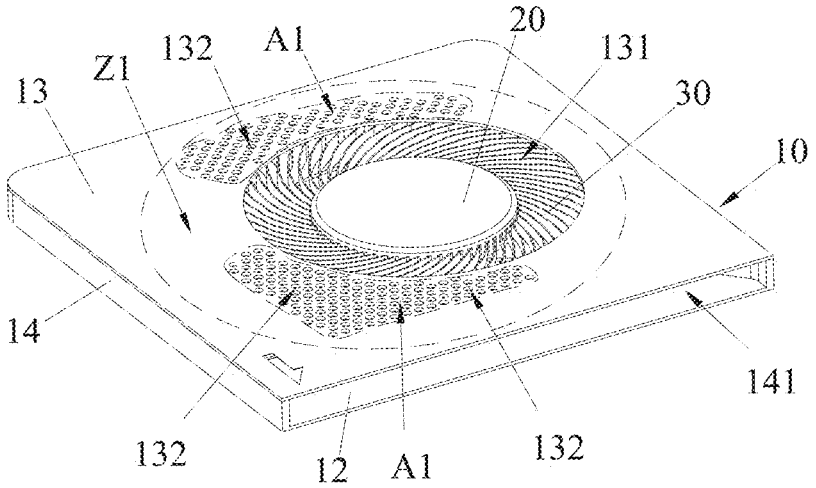
FIG. 11 is a perspective view of a fan according to the sixth embodiment of the invention.
Figure 12:
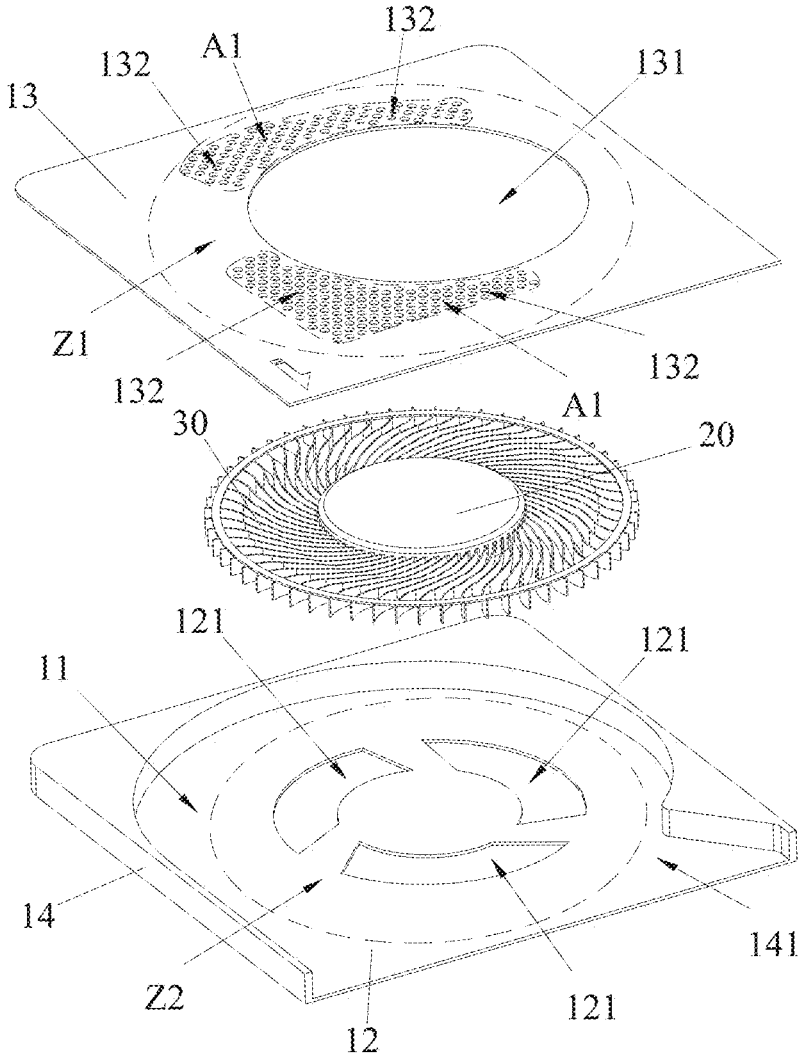
FIG. 12 is an exploded perspective view of the fan shown in FIG. 11.

In some embodiment, two or more first local zones A1 may be configured in the first arrangement zone Z1. Referring to the sixth embodiment of the present invention shown in FIGS. 11 and 12, two first local zones A1 are configured, one of which is configured as that arrangement pattern in the second embodiment, the other of which is configured as that arrangement pattern in the fourth embodiment. In such a way, the air volume is increased since more first auxiliary air inlet holes 132 are set.

It should be noted that the first auxiliary air inlet holes 132 may be arranged on the first local zone A1, in multiple linear rows or arc-shaped rows, or other arrangement patterns. Optionally, the first auxiliary air inlet holes 132 may be arranged in a staggered manner.

In addition to the first auxiliary air inlet holes 132 formed on the first arrangement zone Z1, the base plate 12 may also be provided with holes for increasing the inlet air volume. Note that, the area of the holes on the base plate 12 should be suitable for that the base plate 12 can support the hub 20.

Figure 13:
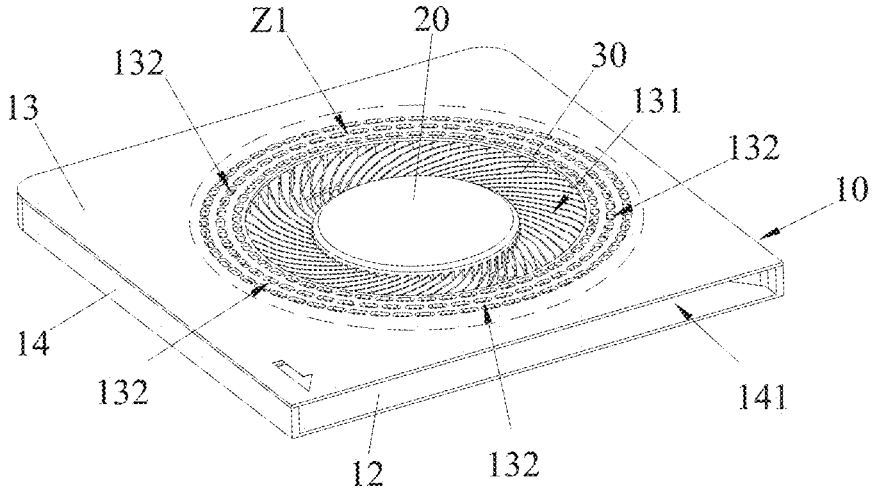
FIG. 13 is a perspective view of a fan according to the seventh embodiment of the invention.
Figure 14:
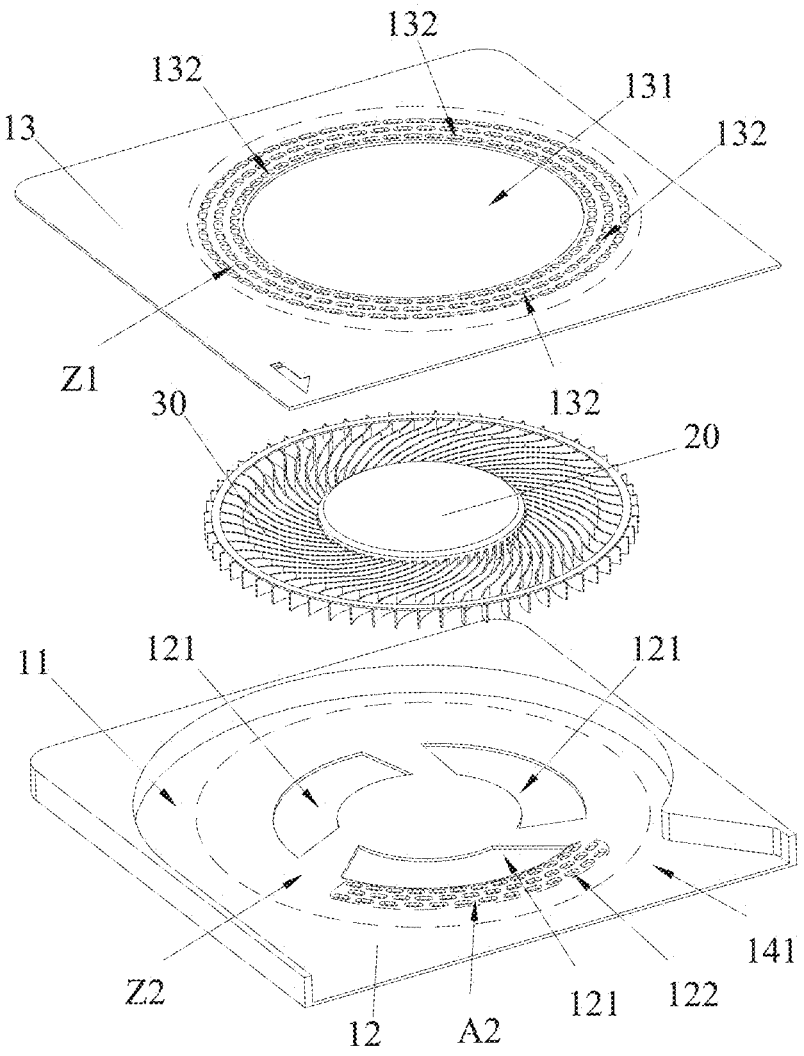
FIG. 14 is an exploded perspective view of the fan shown in FIG. 13.

In a seventh embodiment shown in FIGS. 13 and 14, the base plate 12 is provided with auxiliary air inlets 121 which is connected with the accommodating chamber 11 and smaller than the air inlet 131, compared to the first embodiment. The auxiliary air inlets 121 are located below the air inlet 131, so that the airflow can be directed from both the air inlet 131 and the auxiliary air inlets 121. It should be noted that the area of the auxiliary air inlets 121 is smaller than that of the air inlet 131, thus the air volume directed by the auxiliary air inlets 121 is smaller than that by the air inlet 131. In this embodiment, the base plate 12 is defined with a second arrangement zone Z2 at a position facing to the impeller 30, with multiple second auxiliary air inlet holes 122 formed on the second arrangement zone Z2. In such an arrangement, the inlet air volume is further increased due to the second auxiliary air inlet holes 122, and accordingly the outlet air volume is effectively increased. In the present embodiment, three auxiliary air inlets 121 are formed on the base plate 12, but the number is not limited here. The three auxiliary air inlets 121 are arranged in a circle centered on the center axis of the hub 20 and separated from one another, so as to allow the air flow more evenly. The defined range of the second arrangement zone Z2 is large, and it is not necessary to form with holes in the whole range.

In the embodiments according to the present invention as shown in FIGS. 13 and 14, a second local zone A2 is defined in the second arrangement zone Z2, on which the second auxiliary air inlet holes 132 are distributed. In this embodiment, the shape of the second local zone A2 is identical to that of the first local zone A1 in the fifth embodiment. Multiple second auxiliary air inlet holes 122 are evenly distributed in the second local zone A2. Specifically, in this embodiment, multiple second auxiliary air inlet holes 122 are arranged within the second local zone A2, aligned in three arc-shaped rows. It should be noted that more or less rows of holes also may be set based on actual demands, which is not limited here. Each row may or may not contain a different number of the second auxiliary air inlet holes 122.

Figure 15:
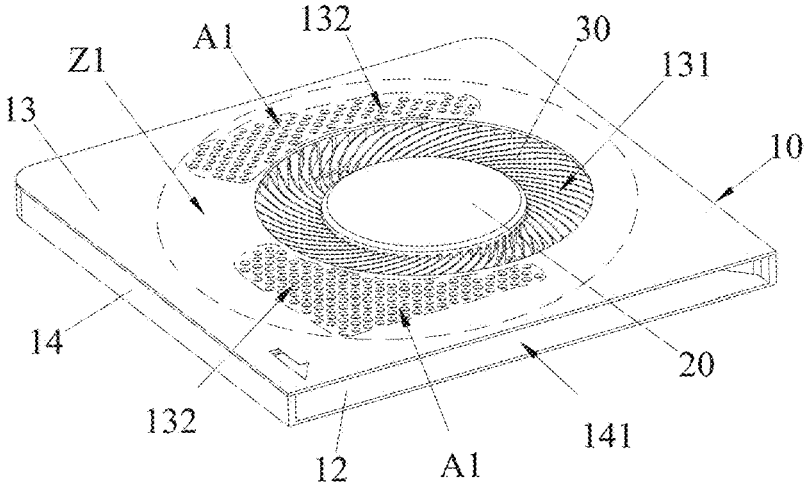
FIG. 15 is a perspective view of a fan according to the eighth embodiment of the invention.
Figure 16:
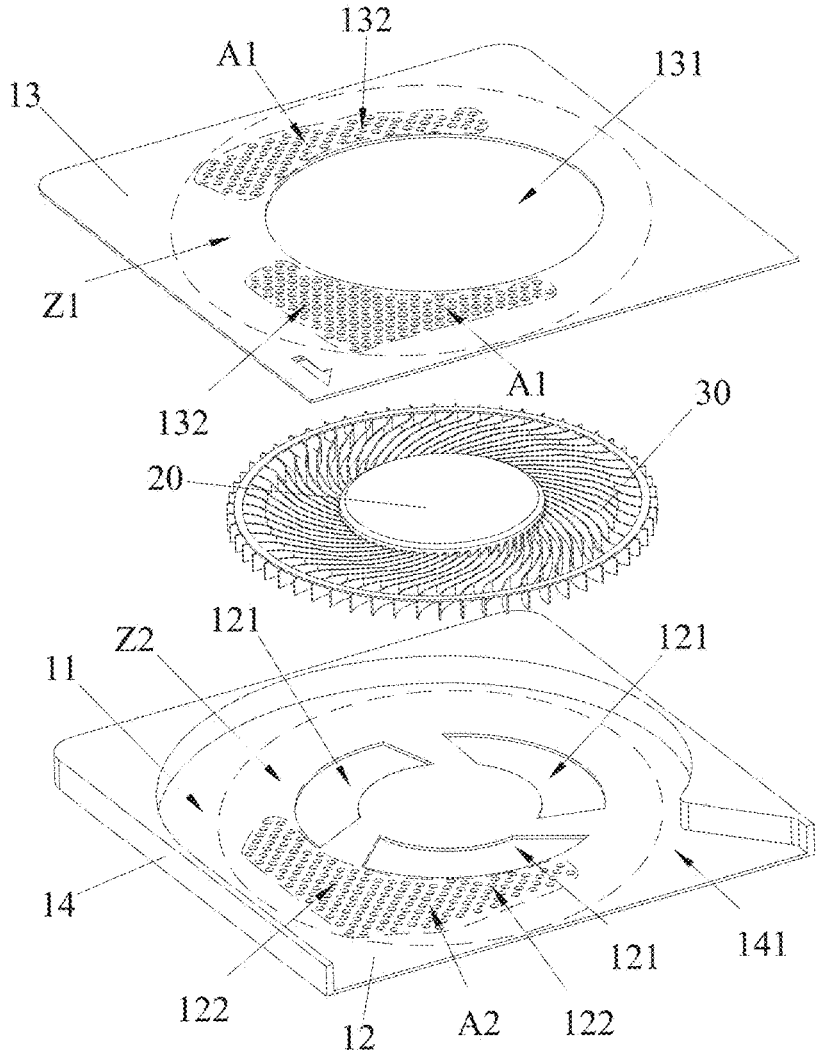
FIG. 16 is an exploded perspective view of the fan shown in FIG. 15.

Referring to the eighth embodiment shown in FIGS. 15 and 16, differences from the seventh embodiment are in that two first local zones A1 are configured on the cover plate 13, one of which is provided with the first auxiliary air inlet holes 132 configured as that arrangement pattern in the second embodiment, the other of which is provided with the first auxiliary air inlet holes 132 configured as that arrangement pattern in the sixth embodiment. Additionally, one second local zone A2 is configured in on the base cover 12, arranged similarly to the second embodiment, with multiple second auxiliary air inlet holes 122 evenly distributed within the second local zone A2. Specifically, in this embodiment, multiple second auxiliary air inlet holes 122 are arranged in multiple linear rows. Each row may contain a different number of the second auxiliary air inlet holes 122.

It should be noted that the arrangement patterns for the second auxiliary air inlet holes 122 are not limited although the above embodiments describe the second auxiliary air inlet holes 122 are arranged in linear rows or arc-shaped rows. Optionally, the second auxiliary air inlet holes 122 may be arranged in a staggered manner.

Figure 19:
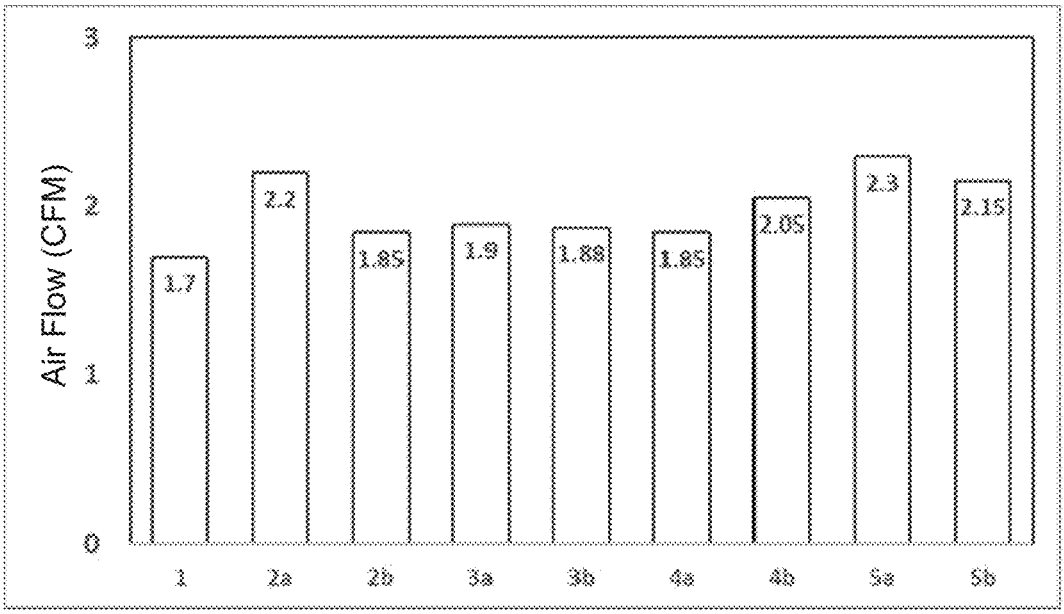
FIG. 19 is an air flow comparison between the fan of the prior art shown in FIG. 17 and the fan of the first to eighth embodiments of the invention tested under a speed of 5000 rpm.

The fan in the present invention can effectively increase outlet air volume compared to prior art. To demonstrate this advantage, experimental simulations were conducted between the fan according to the prior art and the fans according to the first to eighth embodiments of the present invention. FIG. 19 is an air flow comparison diagram between the fan according to the prior art shown in FIG. 17 and the fan according to the first to eighth embodiments of the invention tested under a speed of 5000 rpm. Here, number 1 represents the fan according to the prior art, while 2a-5b respectively represent fans according to the first to the eighth embodiments of the invention. It's seen that the air flow of number 1 is 1.7, whereas the air flow of numbers 2a-5b exceeds 1.7, indicating that the fan of the present invention significantly increases the air flow.

Furthermore, the air flow of the fans in the second embodiment (2a), sixth embodiment (4b), seventh embodiment (5a), and eighth embodiment (5b) each exceed 2, indicating that increased air inlet is beneficial for air flow introduction. By this token, by enlarging or increasing the number of first local zones A1 in the first arrangement zone Z1 and enlarging or increasing the number of second local zones A2 in the second arrangement zone Z2, the number of first auxiliary air inlet holes 132 and second auxiliary air inlet holes 122 is increased, thereby increasing the inlet air volume and subsequently increasing the outlet air volume.

The shell 10 of the present invention is made of metal or plastic. The ratio of the size of the air inlet 131 to the impeller 30 is within the range of 0.6 to 0.9, with a suitable ratio selected within this range.

It is preferable for the first auxiliary air inlet holes 132 and the second auxiliary air inlet holes 122 to be elliptical in shape, although they also may be circular or polygonal (such as quadrilateral or hexagonal) in shape. The spacing between two adjacent first auxiliary air inlet holes 132 is between 1.1 to 4 times the thickness of the cover plate 13, preferably between 1.3 to 1.5 times. Similarly, the spacing between two adjacent second auxiliary air inlet holes 122 is between 1.1 to 4 times the thickness of the base cover 12, preferably between 1.3 to 1.5 times. The diameters of the first auxiliary air inlet holes 132 and the second auxiliary air inlet holes 122 may be uniform or varied.

Preferably, the first auxiliary air inlet holes 132 and second auxiliary air inlet holes 122 may be chemically etched to have a structure having wider ends and a narrower middle, or a tapered structure continuously widening or narrowing from the hub 20. Alternatively, the first auxiliary air inlet holes 132 and second auxiliary air inlet holes 122 may be obtained by physical drilling or stamping, in this case, the first and second auxiliary air inlet holes 132 and 122 have the same diameters from top to bottom.

Whether the first auxiliary air inlet holes 132 and second auxiliary air inlet holes 122 are obtained by physical drilling or stamping, their diameters may be the same from top to bottom, or may be gradually increased/reduced from top to bottom, or may be large at both ends and small in the middle. It should be noted that, under the condition that the control parameters are the same (the structure of the shell, hub and impeller are the same, and the speed is controlled at 5000 rpm), the air flow of the fans according to the first embodiment with different diameters is respectively tested. When the first auxiliary air inlet hole 132 is a hole having the same diameter from top to bottom, the air flow tested is 10.66 CFM. When the first auxiliary air inlet hole 132 is a hole having wider ends and a narrower middle, the air flow tested is 12.56 CFM. In addition, 'when the first auxiliary air inlet hole 132 is a hole gradually increased/reduced from top to bottom, the air flow tested is also greater than 10.66 CFM. It can be seen that the outlet air volume is also improved when the diameters of the first auxiliary air inlet hole 132 are configured as those discussed above.

The above disclosure is only a preferred example of the present invention and cannot be used to limit the scope of rights of the present invention. Therefore, any equivalent changes made in accordance with the claims of the present invention are within the scope of the present invention.

What is claimed is:

1. A fan, comprising a shell, a hub and an impeller, wherein the shell is provided with an accommodating chamber, and the shell comprises a base cover, a cover plate and a side shell that define the accommodating chamber; the base cover and the cover plate are arranged in parallel, the side shell is arranged between the base cover and the cover plate and is connected with the base cover and the cover plate; the cover plate is provided with an air inlet connected with the accommodating chamber and having a diameter smaller than a diameter of the impeller, and the side shell is provided with an air outlet connected with the accommodating chamber; the hub is pivotally installed in the accommodating chamber, the hub and the air inlet are arranged coaxially, the impeller is arranged in the accommodating chamber and connected with the hub, and the impeller follows a synchronous rotation with the hub to produce air flow; a part of the cover plate facing the impeller is defined as a first arrangement zone surrounding the air inlet, and the first arrangement zone is provided with a plurality of first auxiliary air inlet holes;

wherein the base cover is provided with a plurality of auxiliary air inlets connected with the accommodating chamber and having an area smaller than the air inlet, the auxiliary air inlets are located directly below the air inlet, a position of the base cover facing the impeller is defined as a second arrangement zone, and the second arrangement zone is provided with a plurality of second auxiliary air infer holes;

wherein the auxiliary air inlets are arranged in a circle centered on a center axis of the hub and arranged separately from one another, the second arrangement zone includes a second local zone for forming the plurality of second auxiliary air inlet holes, and the plurality of second auxiliary air inlet holes are all distributed on the second local zone;

wherein the first auxiliary air inlet holes and/or second auxiliary air inlet holes have circular, elliptical or polygonal shapes, and spacing between two adjacent first auxiliary air inlet holes is 1.1 to 4 times a thickness of the cover plate, and spacing between the two adjacent second auxiliary air inlet holes is 1.1 to 4 times a thickness of the base cover.

2. The fan according to claim 1, wherein the first auxiliary air inlet holes are distributed throughout the first arrangement zone.

3. The fan according to claim 1, wherein the first arrangement zone includes a first local zone for forming the plurality of first auxiliary air inlet holes, and the plurality of first auxiliary air inlet holes are all distributed on the first local zone.

4. The fan according to claim 3, wherein the plurality of first auxiliary air inlet holes are arranged in linear rows, circular rows or staggered positions in the first local zone.

5. The fan according to claim 3, wherein the first local zone is arranged by surrounding the air inlet.

6. The fan according to claim 1, wherein the second local zone is arranged around at least one of the auxiliary air inlets, and the plurality of second auxiliary air inlet holes are arranged in linear rows, circular rows or staggered positions in the second local zone.

7. The fan according to claim 1, wherein the first auxiliary air inlet holes and/or the second auxiliary air inlet holes have a same diameter from top to bottom, or are gradually increased/reduced from top to bottom, or have wider ends and a narrower middle.

8. The fan according to claim 1, wherein each of the first auxiliary air inlet holes has different diameter, and each of the second auxiliary air inlet holes has different diameter.

9. An electronic device, comprising a housing and a fan mounted in the housing, wherein the fan comprises a shell, a hub and an impeller, the shell is provided with an accommodating chamber, and the shell comprises a base cover, a cover plate and a side shell that define the accommodating chamber; the base cover and the cover plate are arranged in parallel, the side shell is arranged between the base cover and the cover plate and is connected with the base cover and the cover plate; the cover plate is provided with an air inlet connected with the accommodating chamber and having a diameter smaller than a diameter of the impeller, and the side shell is provided with an air outlet connected with the accommodating chamber; the hub is pivotally installed in the accommodating chamber, the hub and the air inlet are arranged coaxially, the impeller is arranged in the accommodating chamber and connected with the hub, and the impeller follows a synchronous rotation with the hub to produce air flow; a part of the cover plate facing the impeller is defined as a first arrangement zone surrounding the air inlet, and the first arrangement zone is provided with a plurality of first auxiliary air inlet holes;

wherein the base cover is provide with a plurality of auxiliary air inlets connected with the accommodating chamber and having an area smaller than the air inlet, the auxiliary air inlets are located directly below the air inlet, a position of the base cover facing the impeller is defined as a second arrangement zone, and the second arrangement zone is provided with a plurality of second auxiliary air inlet holes;

wherein the auxiliary air inlets are arranged in a circle centered on a center axis of the hub and arranged separately from one another, the second arrangement zone includes a second local zone for forming the plurality of second auxiliary air inlet holes, and the plurality of second auxiliary air inlet holes are all distributed on the second local zone;

wherein the first auxiliary air inlet holes and/or the second auxiliary air inlet holes have circular, elliptical or polygonal shapes, and spacing between two adjacent first auxiliary air inlet holes is 1.1 to 4 times a thickness of the cover plate, and spacing between the two adjacent second auxiliary air inlet holes is 1.1 to 4 times a thickness of the base cover.

10. The electronic device according to claim 9, wherein the first auxiliary air inlet holes are distributed throughout the first arrangement zone.

11. The electronic device according to claim 9, wherein the first arrangement zone includes a first local zone for forming the plurality of first auxiliary air inlet holes, and the plurality of first auxiliary air inlet holes are all distributed on the first local zone.

12. The electronic device according to claim 11, wherein the plurality of first auxiliary air inlet holes are arranged in linear rows, circular rows or staggered positions in the first local zone.

13. The electronic device according to claim 11, wherein the first local zone is arranged by surrounding the air inlet.

14. The electronic device according to claim 9, wherein the second local zone is arranged around at least one of the auxiliary air inlets, and the plurality of second auxiliary air inlet holes are arranged in linear rows, circular rows or staggered positions in the second local zone.

15. The electronic device according to claim 9, wherein the first auxiliary air inlet holes and/or the second auxiliary air inlet holes have a same diameter from top to bottom, or are gradually increased/reduced from top to bottom, or have wider ends and a narrower middle.

* * * * *